US008870525B2

(12) United States Patent
Walunj et al.

(10) Patent No.: US 8,870,525 B2
(45) Date of Patent: Oct. 28, 2014

(54) BUCKET ASSEMBLY FOR TURBINE SYSTEM

(75) Inventors: Jalindar Appa Walunj, Bangalore (IN); Mark Steven Honkomp, Taylors, SC (US); Sergio Daniel Marques Amaral, Cambridge, MA (US)

(73) Assignee: General Electric Company, Schenectady, NY (US)

( * ) Notice: Subject to any disclaimer, the term of this patent is extended or adjusted under 35 U.S.C. 154(b) by 503 days.

(21) Appl. No.: 13/289,119

(22) Filed: Nov. 4, 2011

(65) Prior Publication Data

US 2013/0115059 A1 May 9, 2013

(51) Int. Cl.
*F01D 5/18* (2006.01)
*F01D 5/08* (2006.01)
*F01D 9/04* (2006.01)

(52) U.S. Cl.
CPC ..... *F01D 5/187* (2013.01); *F01D 5/081* (2013.01); *F01D 9/041* (2013.01)
USPC ..... 415/115; 416/193 A

(58) Field of Classification Search
CPC ..... F01D 5/186; F01D 5/187; F01D 5/18
USPC ..... 415/115; 416/96 R, 97 R, 193 A
See application file for complete search history.

(56) References Cited

U.S. PATENT DOCUMENTS

| | | | |
|---|---|---|---|
| 4,767,260 | A | 8/1988 | Clevenger et al. |
| 5,098,257 | A | 3/1992 | Hultgren et al. |
| 5,120,192 | A | 6/1992 | Ohtomo et al. |
| 5,197,852 | A | 3/1993 | Walker et al. |
| 5,344,283 | A | 9/1994 | Magowan et al. |
| 5,413,458 | A | 5/1995 | Calderbank |
| 5,591,002 | A | 1/1997 | Cunha et al. |
| 5,609,466 | A | 3/1997 | North et al. |
| 5,634,766 | A | 6/1997 | Cunha et al. |
| 5,639,216 | A | 6/1997 | McLaurin et al. |
| 5,738,489 | A | 4/1998 | Lee |
| 5,813,835 | A | 9/1998 | Corsmeier et al. |
| 5,848,876 | A | 12/1998 | Tomita |
| 5,993,155 | A | 11/1999 | Endres et al. |
| 6,017,189 | A | 1/2000 | Judet et al. |
| 6,019,579 | A | 2/2000 | Fukuno et al. |
| 6,036,436 | A | 3/2000 | Fukuno et al. |
| 6,071,075 | A | 6/2000 | Tomita et al. |
| 6,082,961 | A | 7/2000 | Anderson et al. |
| 6,089,822 | A | 7/2000 | Fukuno |

(Continued)

FOREIGN PATENT DOCUMENTS

| | | |
|---|---|---|
| EP | 0866214 | 9/1998 |

*Primary Examiner* — Dwayne J White
(74) *Attorney, Agent, or Firm* — Dority & Manning, P.A.

(57) ABSTRACT

A bucket assembly for a turbine system is disclosed. The bucket assembly includes a main body having an exterior surface and defining a main cooling circuit. The bucket assembly further includes a platform surrounding the main body and at least partially defining a platform cooling circuit. The platform includes a forward portion and an aft portion each extending between a pressure side slash face and a suction side slash face and further includes a forward face, an aft face, and a top face. The bucket assembly further includes a plenum at least partially defined in the platform. The plenum is in fluid communication with the main cooling circuit and extends from the main cooling circuit towards the suction side slash face.

20 Claims, 5 Drawing Sheets

(56) References Cited

U.S. PATENT DOCUMENTS

| | | | | |
|---|---|---|---|---|
| 6,120,249 | A | 9/2000 | Hultgren et al. | |
| 6,190,130 | B1 | 2/2001 | Fukue et al. | |
| 6,196,799 | B1 | 3/2001 | Fukue et al. | |
| 6,210,111 | B1 | 4/2001 | Liang | |
| 6,241,467 | B1 | 6/2001 | Zelesky et al. | |
| 6,309,175 | B1 | 10/2001 | Hahnle et al. | |
| 6,341,939 | B1 | 1/2002 | Lee | |
| 6,402,471 | B1 | 6/2002 | Demers et al. | |
| 6,431,833 | B2 | 8/2002 | Jones | |
| 6,457,935 | B1 | 10/2002 | Antunes et al. | |
| 6,478,540 | B2 | 11/2002 | Abuaf et al. | |
| 6,481,967 | B2 | 11/2002 | Tomita et al. | |
| 6,506,020 | B2 | 1/2003 | Dailey | |
| 6,508,620 | B2 | 1/2003 | Sreekanth et al. | |
| 6,644,920 | B2 | 11/2003 | Beeck et al. | |
| 6,832,893 | B2 | 12/2004 | Chevrefils et al. | |
| 6,887,033 | B1 * | 5/2005 | Phillips et al. | 415/115 |
| 6,905,301 | B2 | 6/2005 | Tiemann | |
| 6,945,749 | B2 | 9/2005 | De Cardenas | |
| 6,945,750 | B2 | 9/2005 | Benedetti et al. | |
| 7,001,141 | B2 | 2/2006 | Cervenka | |
| 7,004,720 | B2 | 2/2006 | Synnott et al. | |
| 7,097,424 | B2 | 8/2006 | Cunha et al. | |
| 7,131,817 | B2 | 11/2006 | Keith et al. | |
| 7,144,215 | B2 | 12/2006 | Keith et al. | |
| 7,147,439 | B2 | 12/2006 | Jacala et al. | |
| 7,186,089 | B2 | 3/2007 | Liang | |
| 7,255,536 | B2 | 8/2007 | Cunha et al. | |
| 7,309,212 | B2 | 12/2007 | Itzel et al. | |
| 7,374,400 | B2 | 5/2008 | Boswell | |
| 7,416,391 | B2 | 8/2008 | Veltre et al. | |
| 7,497,661 | B2 | 3/2009 | Boury et al. | |
| 2005/0058545 | A1 | 3/2005 | Cardenas | |
| 2006/0056968 | A1 | 3/2006 | Jacala et al. | |
| 2007/0189896 | A1 | 8/2007 | Itzel et al. | |
| 2008/0050223 | A1 | 2/2008 | Liang | |
| 2008/0085190 | A1 | 4/2008 | Liang | |
| 2009/0269184 | A1 | 10/2009 | Spangler et al. | |
| 2010/0135772 | A1 | 6/2010 | Liang | |

* cited by examiner

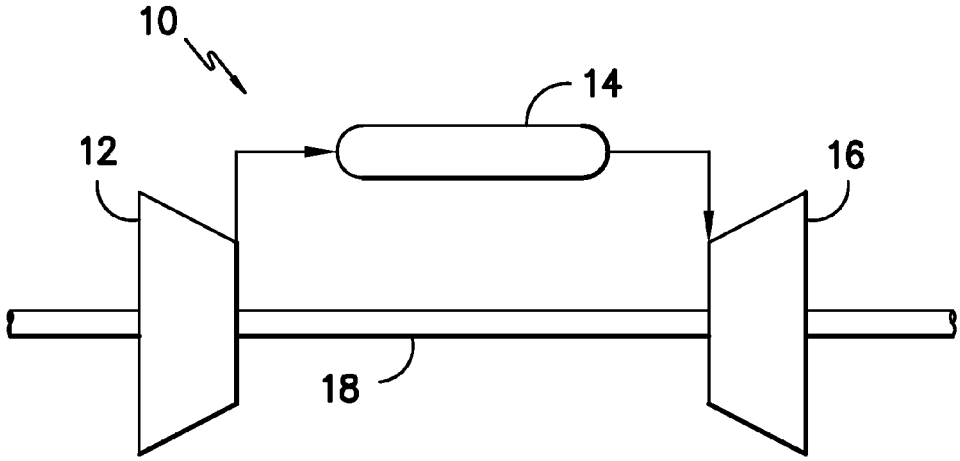
FIG. –1–
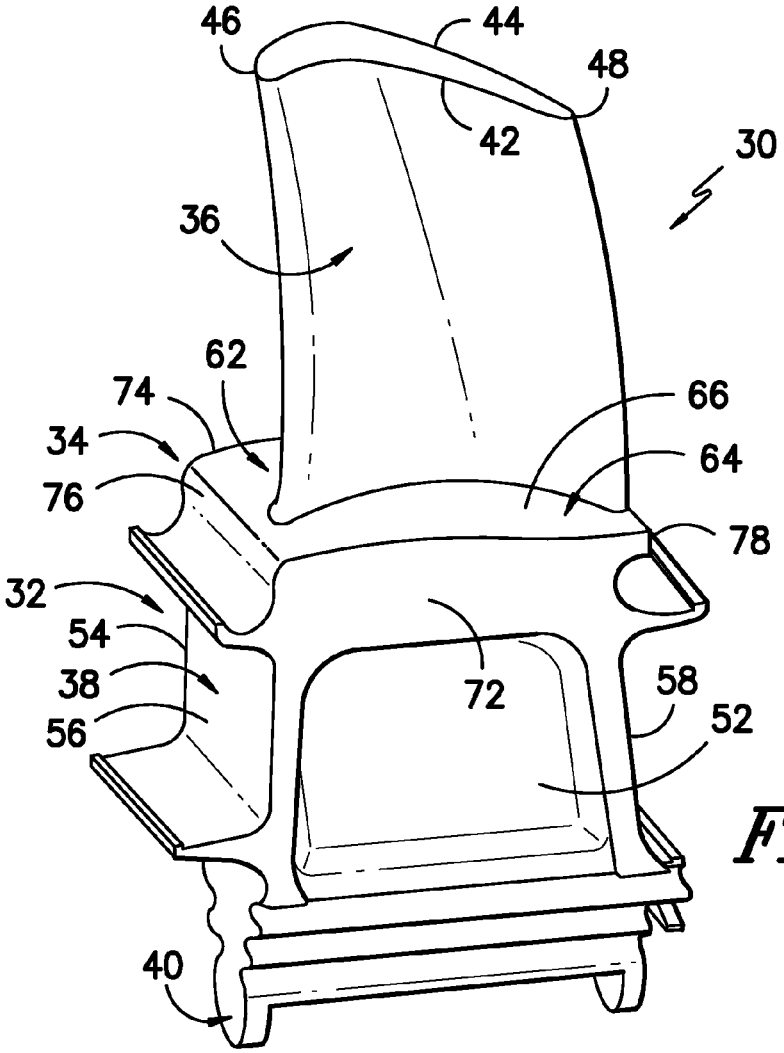
FIG. –2–

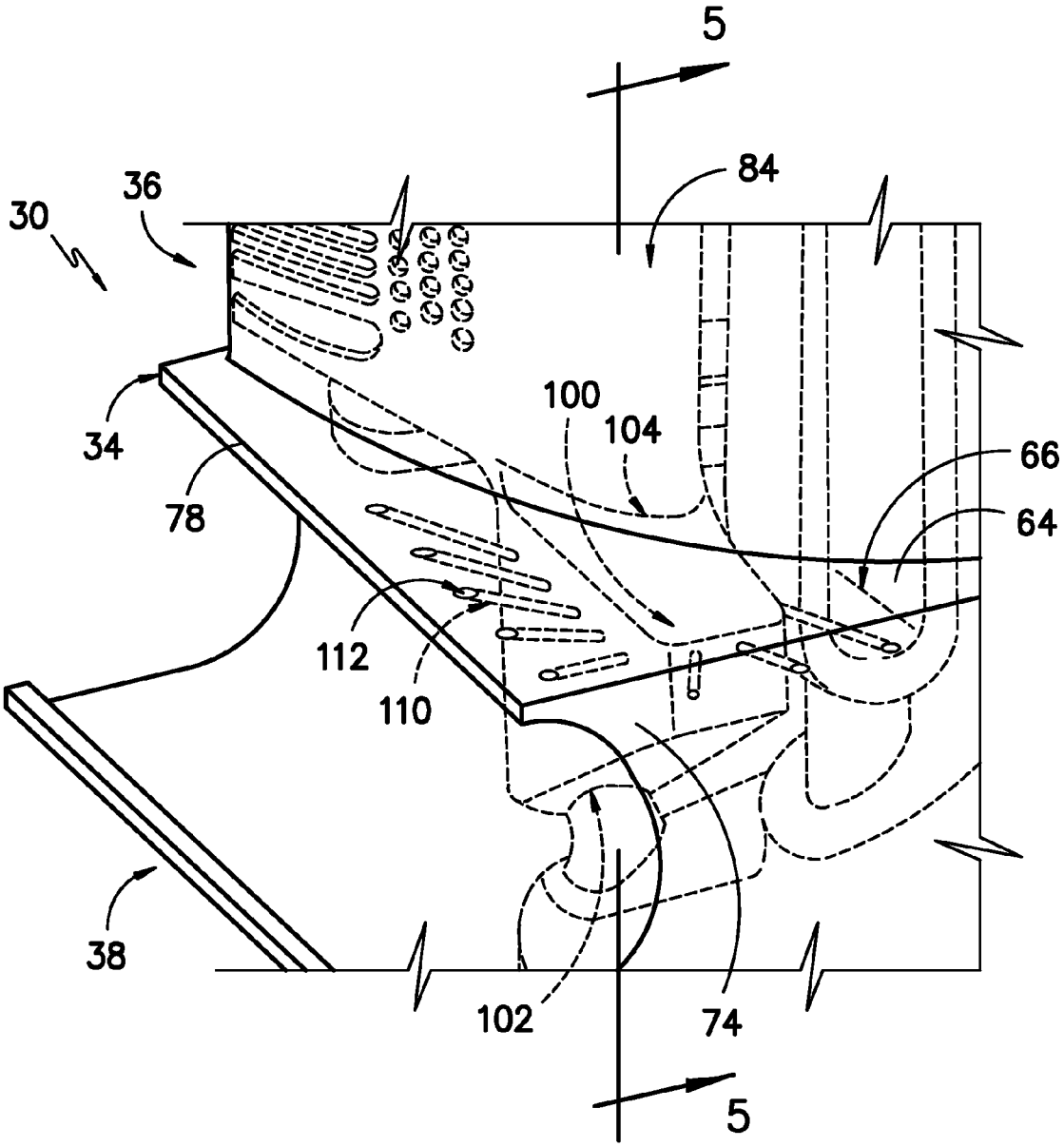
FIG. —4—

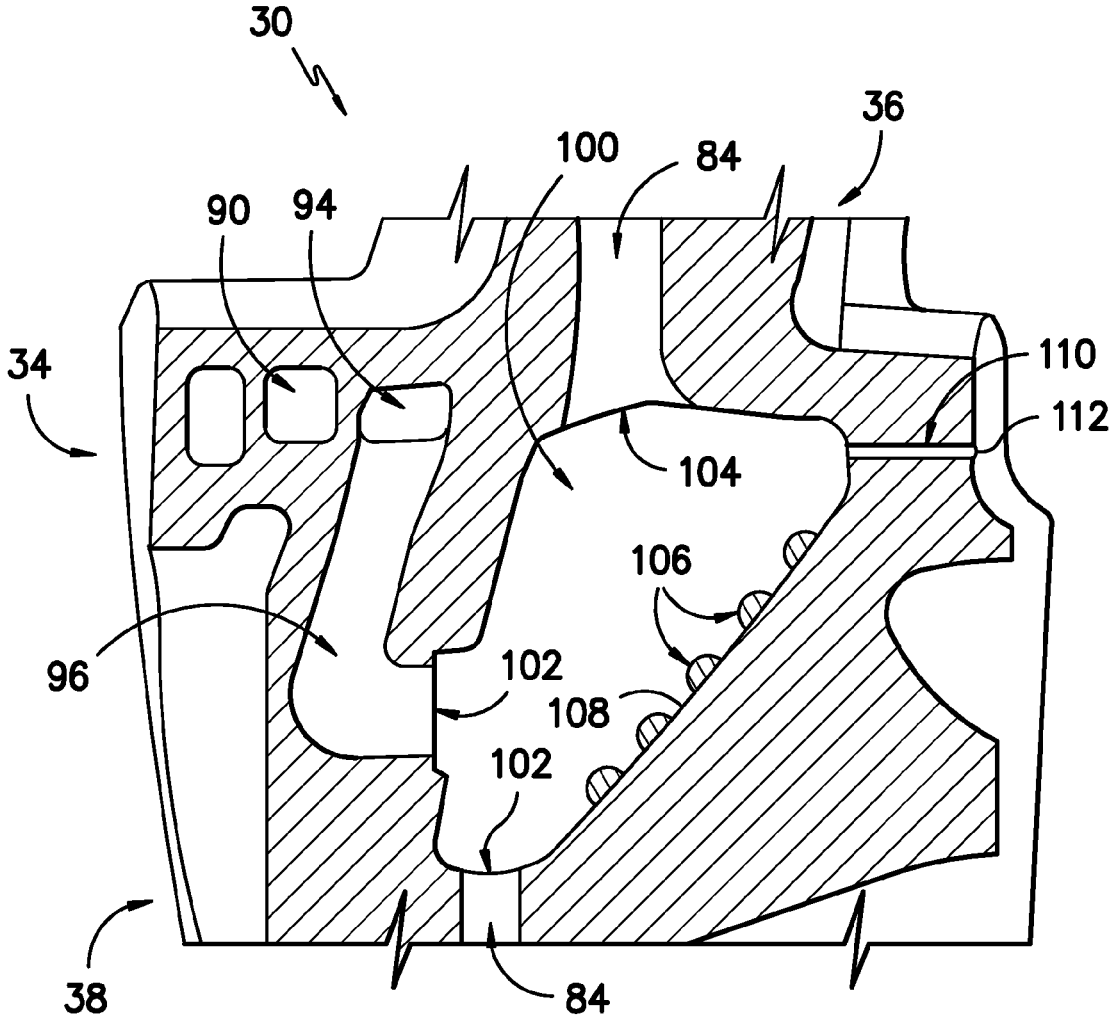
FIG. –5–

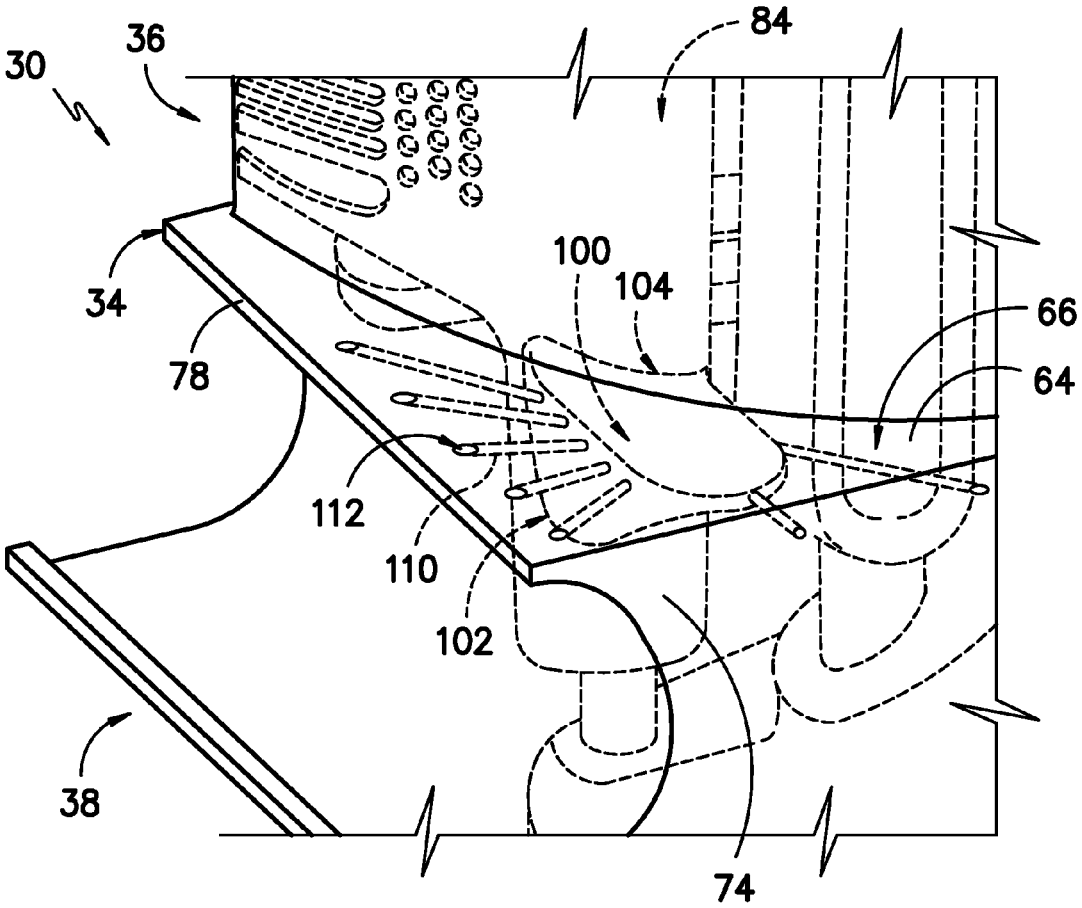
FIG. –6–

BUCKET ASSEMBLY FOR TURBINE SYSTEM

FIELD OF THE INVENTION

The subject matter disclosed herein relates generally to turbine systems, and more specifically to bucket assemblies for turbine systems.

BACKGROUND OF THE INVENTION

Turbine systems are widely utilized in fields such as power generation. For example, a conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

Various strategies are known in the art for cooling various gas turbine system components. For example, a cooling medium may be routed from the compressor and provided to various components. In the compressor and turbine sections of the system, the cooling medium may be utilized to cool various compressor and turbine components.

Buckets are one example of a hot gas path component that must be cooled. For example, various parts of the bucket, such as the airfoil, the platform, the shank, and the dovetail, are disposed in a hot gas path and exposed to relatively high temperatures, and thus require cooling. Various cooling passages and cooling circuits may be defined in the various parts of the bucket, and cooling medium may be flowed through the various cooling passages and cooling circuits to cool the bucket.

In many known buckets, however, various portions of the buckets may reach higher than desired temperatures during operation despite the use of such cooling passages and cooling circuits. For example, despite the use of such cooling passages and cooling circuits in the platforms of known buckets, various portions of the buckets may reach higher than desired temperatures. Specific portions that are of concern in known buckets are the aft portion of the platform and the portion of the platform adjacent to the suction side slash face. Despite the use of known cooling circuits, such as a platform cooling circuit, and the use of cooling air bled from the shank cavity, in platforms, cooling of such portions of the platform may currently be inadequate.

Accordingly, an improved bucket assembly for a turbine system is desired in the art. Specifically, a bucket assembly with improved cooling features would be advantageous.

BRIEF DESCRIPTION OF THE INVENTION

Aspects and advantages of the invention will be set forth in part in the following description, or may be obvious from the description, or may be learned through practice of the invention.

In one embodiment, a bucket assembly for a turbine system is disclosed. The bucket assembly includes a main body having an exterior surface and defining a main cooling circuit. The bucket assembly further includes a platform surrounding the main body and at least partially defining a platform cooling circuit. The platform includes a forward portion and an aft portion each extending between a pressure side slash face and a suction side slash face and further includes a forward face, an aft face, and a top face. The bucket assembly further includes a plenum at least partially defined in the platform. The plenum is in fluid communication with the main cooling circuit and extends from the main cooling circuit towards the suction side slash face.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic illustration of a gas turbine system according to one embodiment of the present disclosure;

FIG. 2 is a perspective view of a bucket assembly according to one embodiment of the present disclosure;

FIG. 4 is a partial perspective view illustrating various internal components of a bucket assembly according to one embodiment of the present disclosure;

FIG. 5 is a cross-sectional view, along the lines 5-5 of FIG. 4, of a bucket assembly according to one embodiment of the present disclosure; and FIG. 6 is a partial perspective view illustrating various internal components of a bucket assembly according to another embodiment of the present disclosure.

DETAILED DESCRIPTION OF THE INVENTION

Figure 3:
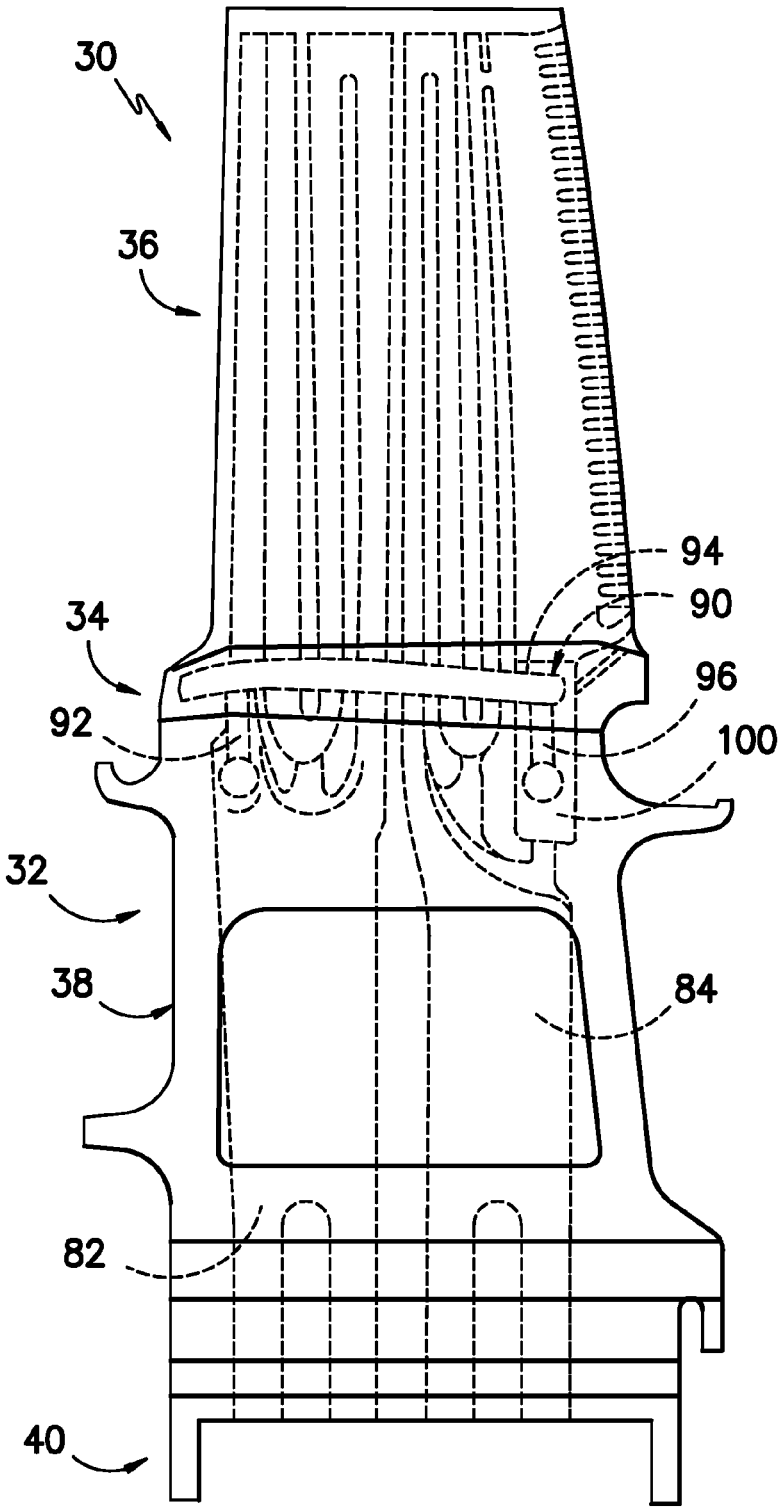
FIG. 3 is a front view illustrating the internal components of a bucket assembly according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, and a turbine 16. The compressor 12 and turbine 16 may be coupled by a shaft 18. The shaft 18 may be a single shaft or a plurality of shaft segments coupled together to form shaft 18.

The turbine 16 may include a plurality of turbine stages. For example, in one embodiment, the turbine 16 may have three stages. A first stage of the turbine 16 may include a plurality of circumferentially spaced nozzles and buckets. The nozzles may be disposed and fixed circumferentially about the shaft 18. The buckets may be disposed circumferentially about the shaft and coupled to the shaft 18. A second stage of the turbine 16 may include a plurality of circumferentially spaced nozzles and buckets. The nozzles may be disposed and fixed circumferentially about the shaft 18. The buckets may be disposed circumferentially about the shaft 18 and coupled to the shaft 18. A third stage of the turbine 16 may include a plurality of circumferentially spaced nozzles and buckets. The nozzles may be disposed and fixed circumferentially about the shaft 18. The buckets may be disposed circumferentially about the shaft 18 and coupled to the shaft 18. The various stages of the turbine 16 may be at least partially disposed in the turbine 16 in, and may at least partially define, a hot gas path (not shown). It should be understood that the turbine 16 is not limited to three stages, but rather that any number of stages are within the scope and spirit of the present disclosure.

Similarly, the compressor 12 may include a plurality of compressor stages (not shown). Each of the compressor 12 stages may include a plurality of circumferentially spaced nozzles and buckets.

One or more of the buckets in the turbine 16 and/or the compressor 12 may comprise a bucket assembly 30, as shown in FIGS. 2 through 5. The bucket assembly 30 may include a main body 32 and a platform 34. The main body 32 typically includes an airfoil 36 and a shank 38. The airfoil 36 may be positioned radially outward from the shank 38. The shank 38 may include a root 40, which may attach to a rotor wheel (not shown) in the turbine system 10 to facilitate rotation of the bucket assembly 30.

In general, the main body 32 has an exterior surface. In embodiments wherein the main body 32 includes an airfoil 36 and shank 38, for example, the portion of the exterior surface defining the airfoil 36 may have a generally aerodynamic contour. For example, the airfoil 32 may have an exterior surface defining a pressure side 42 and suction side 44 each extending between a leading edge 46 and a trailing edge 48. Further, the portion of the exterior surface of the shank 38 may include a pressure side face 52, a suction side face 54, a leading edge face 56, and a trailing edge face 58.

The platform 34 may generally surround the main body 32, as shown. A typical platform may be positioned at an intersection or transition between the airfoil 36 and shank 38 of the main body 32, and extend outwardly in the generally axial and tangential directions. It should be understood, however, that a platform according to the present disclosure may have any suitable position relative to the main body 32 of the bucket assembly 30.

A platform 34 according to the present disclosure may include a forward portion 62 and an aft portion 64. The forward portion 62 is that portion of the platform 34 positioned proximate the leading edge 46 of the airfoil 36 and the leading edge face 56 of the shank 38, while the aft portion 64 is that portion of the platform 34 positioned proximate the trailing edge 48 of the airfoil 36 and the trailing edge 58 of the shank 38. The forward portion 62 and the aft portion 64 may further define a top face 66 of the platform 34, which may generally surround the airfoil 36 as shown. Further, a peripheral edge may surround the forward portion 62, aft portion 64, and top face 66. The peripheral edge may include a pressure side slash face 72 and suction side slash face 74, which each of the forward portion 62 and the aft portion 64 may extend between. The peripheral edge may further include a forward face 76, which may define a peripheral edge of the forward portion 62, and an aft face 78, which may define a peripheral edge of the aft portion 64.

As shown in FIGS. 3 through 5, the main body 32 may define one or more main cooling circuits therein. The main cooling circuits may extend through portions of the main body 32 to cool the main body 32. For example, in some embodiments as shown, the main body 32 may define a forward main cooling circuit 82 and an aft main cooling circuit 84. The main cooling circuits may have any suitable shape and may extend along any suitable path. For example, as shown each main cooling circuit may have various branches and serpentine portions and may extend through the various portions of the main body 32, such as through the airfoil 36 and shank 38. A cooling medium may be flowed into and through the various main cooling circuits 82, 84 to cool the main body 32. For example, as shown, the cooling medium may be flowed into portions of the main cooling circuits 82, 84 that are at least partially defined in the shank 38. This cooling medium 32 may then flow through the portion at least partially defined in the shank 38, cooling the shank 38, and then flow into a portion at least partially defined in the airfoil 36. The cooling medium may flow through the portion at least partially defined in the airfoil 36, cooling the airfoil 36. The cooling medium may then flow into another main cooling circuit 82, 84 and/or be exhausted from the main cooling circuit 82, 84.

As further shown in FIGS. 3 through 5, one or more platform cooling circuits 90 may be defined in the bucket assembly 30. In general, the platform cooling circuit 90 may be defined at least partially in the platform 34. For example, in exemplary embodiments, a portion of the platform cooling circuit 90 is defined in the platform 34, and extends through the platform 34 to cool it. Other portions of the platform cooling circuit 90 may extend into the main body 32 to inlet cooling medium into the platform cooling circuit 90 or exhaust the cooling medium therefrom. In one embodiment, as shown in FIG. 3, a platform cooling circuit 90 may include an inlet portion 92, an intermediate portion 94, and an outlet portion 96. The inlet portion 92 and outlet portion 96 may extend from the platform 34 into the main body 32, and the intermediate portion 94 may extend through the platform 34. Cooling medium may flow into the platform cooling circuit 90 through the inlet portion 92, flow through intermediate portion 94, and be exhausted through the outlet portion 96.

In many bucket assemblies 30, a platform cooling circuit 90 is in fluid communication with a main cooling circuit, such that cooling medium is flowed from a main cooling circuit into the platform cooling circuit 90 and/or is flowed from a platform cooling circuit 90 to a main cooling circuit. For example, in the embodiment shown in FIGS. 3 through 5, the inlet portion 92 of the platform cooling circuit 90 may be in fluid communication with the forward main cooling circuit 82, while the outlet portion 96 is in fluid communication with the aft main cooling circuit 84.

A bucket assembly according to the present disclosure may further advantageously include one or more plenums 100 defined in the bucket assembly 30, as shown in FIGS. 3 through 6. A plenum 100 according to the present disclosure may be at least partially defined in the platform 34. Further, in some embodiments, portions of the plenum 100 may be defined in the main body 32, such as in the shank 38. Further, a plenum 100 according to the present disclosure may be in fluid communication with a main cooling circuit. For example, in exemplary embodiments as shown, a plenum 100 may be in fluid communication with an aft main cooling circuit 84. Alternatively, however, a plenum 100 may be in fluid communication with a forward main cooling circuit 82 or any other suitable main cooling circuit. Such plenums 100 may thus be extensions of main cooling circuits, which may allow for flowing, mixing and/or swirling of cooling medium therein. For example, cooling medium flowing through a main cooling circuit may flow into and through a plenum 100 through an inlet 102 before exiting back into the main cooling circuit through an outlet 104. Flowing of cooling medium into and through such plenums 100 may advantageously allow the cooling medium to reach portions of the platform 34 that have been previously unavailable to previously known buckets 30, thus allowing cooling of such portions.

Further, in some embodiments, as shown in FIG. 5, a plenum 100 may further be in fluid communication with a platform cooling circuit 90. For example, a plenum 100 may be in fluid communication with the outlet portion 96 of a platform cooling circuit 90 as shown, or with the inlet portion 92, intermediate portion 94, or any other suitable portion. Cooling medium may thus flow from the platform cooling circuit 90 to the plenum 100 or vice versa. In exemplary embodiments as shown, cooling medium may flow from a platform cooling circuit 90 into a plenum 100 through an inlet 102, and may mix with cooling medium flowed into the plenum 100 from a main cooling circuit. Such mixing may advantageously allow for balancing of the temperature of the cooling medium in the plenum 100 in order to provide better cooling of the various portions of the platform 34.

As mentioned, a plenum 100 according to the present disclosure may be an extension of a main cooling circuit. Further, in exemplary embodiments as shown, a plenum 100 may extend from the main cooling circuit towards the suction side slash face 74. Thus, cooling medium flowed into a plenum 100 from a main cooling circuit may flow generally towards the suction side slash face, cooling portions of the platform 34 near or adjacent to the suction side slash face 74.

In some embodiments, as shown in FIGS. 3 through 6, a plenum 100 according to the present disclosure may be at least partially defined in the aft portion 64 of a platform 34. In these embodiments, portions of the aft portion 64 near or adjacent to the plenum 100 may advantageously be cooled. In other embodiments, a plenum 100 may be at least partially defined in the forward portion 62 of a platform 34. Further, in some embodiments, as shown in FIGS. 3 through 6, a plenum 100 according to the present disclosure may be at least partially defined adjacent to the aft face 78 of a platform 34. Alternatively, however, a plenum 100 may be at least partially defined at any suitable location between the forward face 76 and aft face 78.

As shown, in some embodiments a plenum 100 according to the present disclosure may have a taper in a suitable direction. Such taper may direct the flow of cooling medium in the plenum 100 in a desirable direction to cool various portions of the platform 34. For example, in some embodiments as shown in FIGS. 4 through 6, a plenum 100 may taper in a direction from the platform 34 towards the root 40. The taper may be inwards from the suction side slash face 74 towards the main cooling circuit. Thus, as cooling medium enters the plenum 100 at inlets 102 as shown, the cooling medium may flow upwards and outwards towards the suction side slash face 74 to cool the portions of the platform 34 adjacent to the plenum 100 before exiting the plenum 100 through outlets 104. In other embodiments, a plenum 100 may taper in a direction from the aft face 78 towards the forward face 76, as shown in FIG. 6, or may taper in a direction from the forward face 76 towards the aft face 78. Such tapers may thus advantageously direct the flow of cooling medium within the plenum 100 as desired to cool various portions of the platform 34.

In some embodiments, as shown in FIG. 5, one or more turbulators 106 may be disposed in a plenum 100, such as on an inner surface 108 of the plenum 100. A turbulator 106 is a surface disruption, such as a protrusion or depression. A turbulator 106 according to the present disclosure may have any suitable shape and size. For example, a turbulator 106 may be spherical, cubical, cuboid-shaped, conical, cylindrical, pyramid-shaped, prism-shaped, or have any other suitable shape. Turbulators 106 may advantageously disrupt the flow of cooling medium within a plenum 100, thus swirling or otherwise imparting various flow characteristics onto the flow. This may further enhance cooling of the portions of the platform 34 near the plenum 100.

In some embodiments, a bucket assembly 30 according to the present disclosure may further include one or more exhaust passages 110. Each exhaust passage 110 may be defined in the platform 34, such as in the aft portion 64 of the platform 34 as shown and/or in the forward portion 62 of the platform 34, and may be in fluid communication with a plenum 100. Thus, cooling medium flowing through a plenum 100 may flow from the plenum 100 into an exhaust passage 110.

Each exhaust passage 110 may further include an outlet 112. The outlet 112 may be defined in any suitable location on the platform 34, such as on the aft portion 64 and/or forward portion 62 of the platform 34. For example, an outlet 112 may be defined in the top face 66 as shown, or in the suction side slash face 74 as shown, or in the pressure side slash face 72, forward face 76, aft face 78, or any other suitable location on the platform 34, such as on the aft portion 64 and/or forward portion 62 of the platform 34. Cooling medium 100 flowed through an exhaust passage 110 may thus be exhausted through the outlet 112 of that exhaust passage 110. Additionally, in some embodiments, such exhausted cooling medium may further advantageously act as a cooling film to cool the exterior of the platform 34.

Plenums 100 according to the present disclosure may thus advantageously cool various portions of the platform 34, such as the aft portion 64 of the platform 34, the portion of the platform 34 adjacent to the suction side slash face 74, and/or other suitable portions of the platform 34. Such plenums 100 provide a novel approach to cooling a platform 34 that prevents such portions of the platform 34 from reaching undesirably hot temperatures. Additionally, the use of such plenums 100 may advantageously provide mixing of cooling medium from various sources, such as from a main cooling circuit and platform cooling circuit 90, may advantageously provide swirling or other flow characteristics to the cooling medium, and may further advantageously reduce the weight of a bucket assembly 30. Such weight reduction can allow tailoring of the balance of the bucket assembly 30 for more uniform loading of the various bucket assemblies 30 in the turbine system 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bucket assembly for a turbine system, comprising:

a main body having an exterior surface and defining a main cooling circuit;

a platform surrounding the main body and at least partially defining a platform cooling circuit, the platform comprising a forward portion and an aft portion each extending between a pressure side slash face and a suction side slash face and further comprising a forward face, an aft face, and a top face; and a plenum at least partially defined in the platform, the plenum in fluid communication with the main cooling circuit and extending from the main cooling circuit towards the suction side slash face;

wherein the plenum tapers in at least one of a direction from the platform towards a root of the bucket assembly or a direction from the aft face towards the forward face.

2. The bucket assembly of claim 1, wherein the plenum is in fluid communication with the platform cooling circuit.

3. The bucket assembly of claim 1, wherein the main cooling circuit is an aft main cooling circuit.

4. The bucket assembly of claim 1, wherein the plenum is at least partially defined in the aft portion of the platform.

5. The bucket assembly of claim 1, further comprising a turbulator disposed in the plenum.

6. The bucket assembly of claim 1, further comprising an exhaust passage defined in the platform and in fluid communication with the plenum.

7. The bucket assembly of claim 6, wherein an outlet of the exhaust passage is defined in the top face of the platform.

8. The bucket assembly of claim 6, wherein an outlet of the exhaust passage is defined in the suction side slash face of the platform.

9. A turbine system, comprising:

a compressor;

a turbine coupled to the compressor; and a plurality of bucket assemblies disposed in at least one of the compressor or the turbine, at least one of the bucket assemblies comprising:

a main body having an exterior surface and defining a main cooling circuit;

a platform surrounding the main body and at least partially defining a platform cooling circuit, the platform comprising a forward portion and an aft portion each extending between a pressure side slash face and a suction side slash face and further comprising a forward face, an aft face, and a top face; and a plenum at least partially defined in the platform, the plenum in fluid communication with the main cooling circuit and extending from the main cooling circuit towards the suction side slash face;

wherein the plenum tapers in at least one of a direction from the platform towards a root of the bucket assembly or a direction from the aft face towards the forward face.

10. The turbine system of claim 9, wherein the plenum is in fluid communication with the platform cooling circuit.

11. The turbine system of claim 9, wherein the main cooling circuit is an aft main cooling circuit.

12. The turbine system of claim 9, wherein the plenum is at least partially defined in the aft portion of the platform.

13. The turbine system of claim 9, further comprising a turbulator disposed in the plenum.

14. The turbine system of claim 9, further comprising an exhaust passage defined in the platform and in fluid communication with the plenum.

15. The turbine system of claim 14, wherein an outlet of the exhaust passage is defined in the top face of the platform.

16. The turbine system of claim 14, wherein an outlet of the exhaust passage is defined in the suction side slash face of the platform.

17. A bucket assembly for a turbine system, comprising:

a main body having an exterior surface and defining a main cooling circuit, the main body comprising an airfoil and a shank;

a platform surrounding the main body and at least partially defining a platform cooling circuit, the platform comprising a forward portion and an aft portion each extending between a pressure side slash face and a suction side slash face and further comprising a forward face, an aft face, and a top face; and a plenum partially defined in the platform and partially define in the shank, the plenum in fluid communication with the main cooling circuit and extending from the main cooling circuit towards the suction side slash face, wherein an inlet to the plenum from the main cooling circuit is defined in the shank.

18. The bucket assembly of claim 17, wherein the plenum is in fluid communication with the platform cooling circuit.

19. The bucket assembly of claim 17, wherein the plenum is at least partially defined in the aft portion of the platform.

20. The bucket assembly of claim 17, further comprising an exhaust passage defined in the platform and in fluid communication with the plenum.

* * * * *

UNITED STATES PATENT AND TRADEMARK OFFICE

CERTIFICATE OF CORRECTION

PATENT NO. : 8,870,525 B2
APPLICATION NO. : 13/289119
DATED : October 28, 2014
INVENTOR(S) : Jalindar Appa Walunj et al.

It is certified that error appears in the above-identified patent and that said Letters Patent is hereby corrected as shown below:

In the claims

In Column 8, line 29: "define" should be "defined"

Signed and Sealed this
Third Day of May, 2016

Michelle K. Lee

Michelle K. Lee
*Director of the United States Patent and Trademark Office*